US008666283B2

(12) United States Patent
Hayakawa

(10) Patent No.: US 8,666,283 B2
(45) Date of Patent: Mar. 4, 2014

(54) IMAGE FORMING APPARATUS HAVING A PRESSING MEMBER THAT PRESSES A BELT UNIT FOR POSITIONING IN A MAIN BODY

(75) Inventor: Shigeki Hayakawa, Kariya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 609 days.

(21) Appl. No.: 12/882,587

(22) Filed: Sep. 15, 2010

(65) Prior Publication Data

US 2011/0064467 A1 Mar. 17, 2011

(30) Foreign Application Priority Data

Sep. 16, 2009 (JP) ..... 2009-214699

(51) Int. Cl.
*G03G 15/08* (2006.01)

(52) U.S. Cl.
USPC ..... 399/121

(58) Field of Classification Search
USPC ..... 399/121, 302, 313, 297, 298, 301
See application file for complete search history.

(56) References Cited

U.S. PATENT DOCUMENTS

| | | | | |
|---|---|---|---|---|
| 5,172,175 | A * | 12/1992 | Sekino et al. | 399/299 |
| 7,506,866 | B2 | 3/2009 | Igarashi | |
| 7,555,238 | B2 | 6/2009 | Igarashi | |
| 7,586,806 | B2 | 9/2009 | Maru et al. | |
| 7,620,344 | B2 | 11/2009 | Igarashi | |
| 7,856,192 | B2 | 12/2010 | Koishi et al. | |
| 7,890,012 | B2 | 2/2011 | Koishi et al. | |
| 2005/0169667 | A1 | 8/2005 | Katoh | |
| 2006/0002735 | A1 | 1/2006 | Tamaru et al. | |
| 2006/0067732 | A1 | 3/2006 | Igarashi | |
| 2006/0079358 | A1 | 4/2006 | Igarashi | |
| 2006/0180973 | A1 | 8/2006 | Igarashi | |
| 2007/0048005 | A1 | 3/2007 | Nakano et al. | |
| 2007/0147891 | A1 | 6/2007 | Mori | |
| 2008/0159772 | A1 | 7/2008 | Koishi et al. | |
| 2008/0159775 | A1 | 7/2008 | Koishi et al. | |

FOREIGN PATENT DOCUMENTS

| | | | |
|---|---|---|---|
| JP | 2004-302375 | A | 10/2001 |
| JP | 2002-070956 | A | 3/2002 |
| JP | 2003-241618 | A | 8/2003 |

(Continued)

OTHER PUBLICATIONS

JP Decision to Grant dtd Nov. 8, 2011; JP Application No. 2009-214699; English Translation.

(Continued)

*Primary Examiner* — Billy J Lactaoen
(74) *Attorney, Agent, or Firm* — Banner & Witcoff, Ltd.

(57) ABSTRACT

An image forming apparatus configured to form an image on a recording sheet is provided. The image forming apparatus includes a main body, a belt unit, and a pressing member configured to press the belt unit in a pressing direction crossing both a belt extending direction and an axial direction of a belt roller. A first positioning portion is disposed in the main body and a second positioning portion is disposed in the belt unit. A second positioning portion is disposed in the belt unit and configured to contact the first positioning portion to allow the belt unit to be positioned in the main body, and the pressing member is configured to press the belt unit such that the second positioning portion maintains contact with the first positioning portion.

17 Claims, 13 Drawing Sheets

(56) References Cited

FOREIGN PATENT DOCUMENTS

| | | | |
|---|---|---|---|
| JP | 2005-189664 | A | 7/2005 |
| JP | 2006-267620 | A | 10/2006 |
| JP | 2007-057952 | A | 3/2007 |
| JP | 2007-101728 | A | 4/2007 |
| JP | 2007-178555 | A | 7/2007 |
| JP | 2008-165023 | A | 7/2008 |
| JP | 2008-286829 | A | 11/2008 |
| JP | 2009-157389 | A | 7/2009 |

OTHER PUBLICATIONS

JP Office Action dtd Jun. 21, 2011; JP Application No. 2009-214699; English Translation.

* cited by examiner

IMAGE FORMING APPARATUS HAVING A PRESSING MEMBER THAT PRESSES A BELT UNIT FOR POSITIONING IN A MAIN BODY

CROSS REFERENCE TO RELATED APPLICATION

This application claims priority from Japanese Patent Application No. 2009-214699, filed on Sep. 16, 2009, the entire subject matter of which is incorporated herein by reference.

FIELD

Aspects of the disclosure relate to an image forming apparatus.

BACKGROUND

A known image forming apparatus includes a belt unit. Generally, the belt unit is detachably attached to an apparatus body, e.g. a main body frame, of the image forming apparatus. The belt unit includes a positioning protrusion. The positioning protrusion is inserted into a positioning hole provided in the main body frame such that the belt unit is positioned relative to the main body frame.

To facilitate the operation for attaching the belt unit to the apparatus body, a diameter of the positioning hole can be greater than that of the positioning protrusion.

However, if the diameter of the positioning hole is greater than that of the positioning protrusion, when the positioning protrusion is only inserted into the positioning hole, a certain amount of play between the positioning hole and the positioning protrusion occurs due to a difference in diameter size, and the belt unit may not be accurately positioned relative to the main body.

When the positioning protrusion is inserted into the positioning hole, an outer surface of the positioning protrusion can be brought into contact with an inner wall surface defining the positioning hole, such that the play between the belt unit and the main body can be eliminated.

In the above known image forming apparatus, the positioning hole is formed like an elongated hole, and the positioning protrusion is formed like a cylindrical column. The cylindrical column is inserted into the elongated hole, the belt unit is urged downward by an urging force of a spring, and the belt unit is secured to the main body. With this structure, there is a high probability that the belt unit may be secured to the main body with the outer surface of the positioning protrusion spaced away from the inner wall of the positioning hole in a direction perpendicular to a direction of the urging force, especially in a direction of the minor axis of the positioning hole.

In short, there is a high probability that belt unit may be secured to the main body without accurate positioning.

SUMMARY

Aspects of the disclosure may provide an image forming apparatus in which a belt unit can be accurately positioned relative to a main body of the image forming apparatus.

BRIEF DESCRIPTION OF THE DRAWINGS

Illustrative aspects of the disclosure will be described in detail with reference to the following figures in which like elements are labeled with like numbers and in which.

DETAILED DESCRIPTION

An illustrative embodiment of the disclosure will be described in detail with reference to the accompanying drawings. Aspects of the disclosure are applied to an image forming apparatus, e.g. an electrophotographic image forming apparatus.

A first embodiment of the disclosure will be described.

The general structure of an illustrative image forming apparatus 1 will be described with reference to FIG. 1.

For ease of discussion, in the following description, the top or upper side, the bottom or lower side, the left or left side, the right or right side, the front or front side, and the rear or rear side of the image forming apparatus 1 will be identified as indicated by the arrows in FIG. 1. With regard to various individual objects of the image forming apparatus 1, sides of the individual objects will be similarly identified based on the arranged/attached position of the object on/in the image forming apparatus 1 shown in FIG. 1. The top and bottom direction may be referred to as a height direction, and the left and right direction may be referred to as a width direction.

Figure 1:
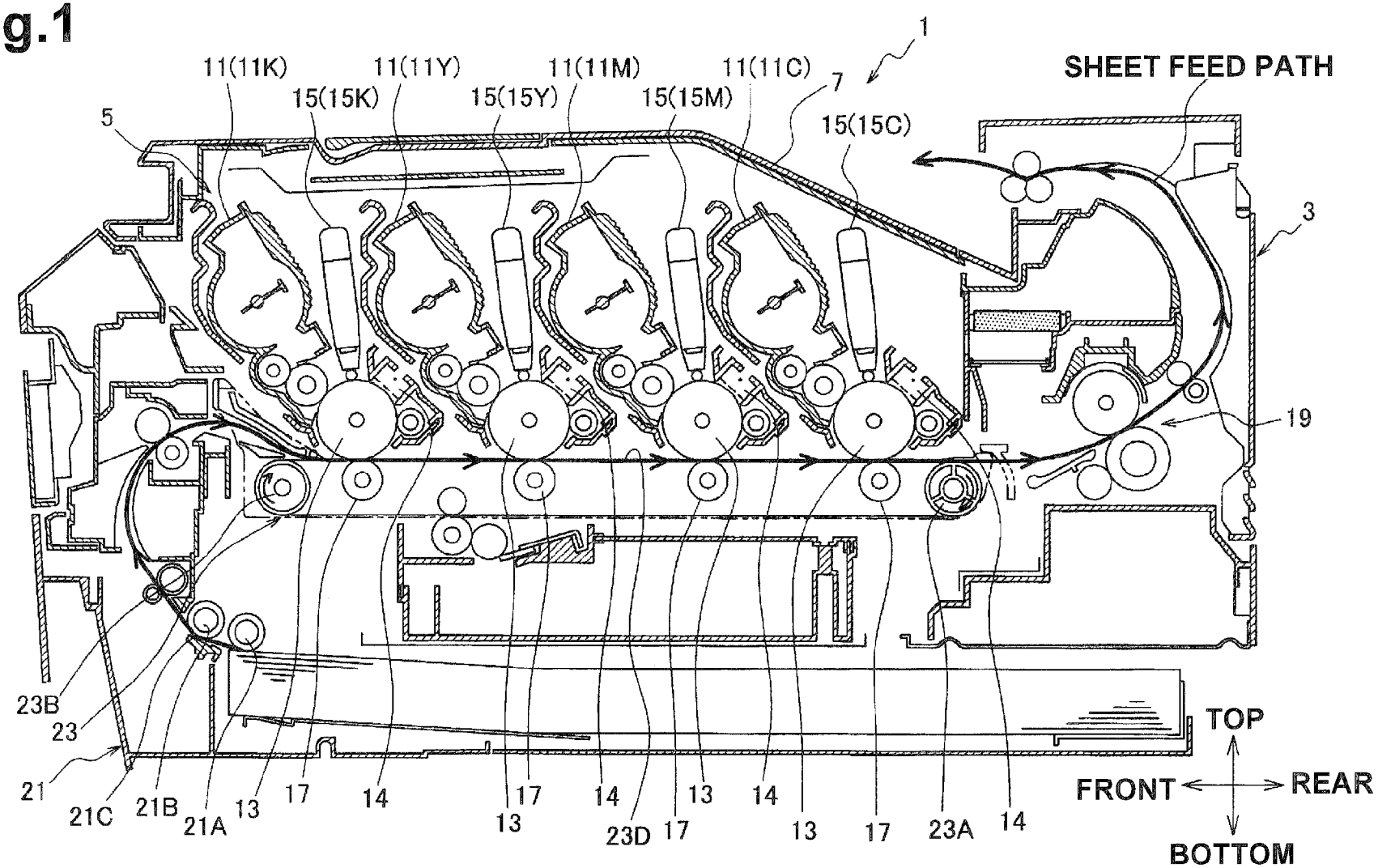
FIG. 1 is a sectional view schematically illustrating an image forming apparatus in which a top cover is closed according to an illustrative embodiment.
Figure 2:
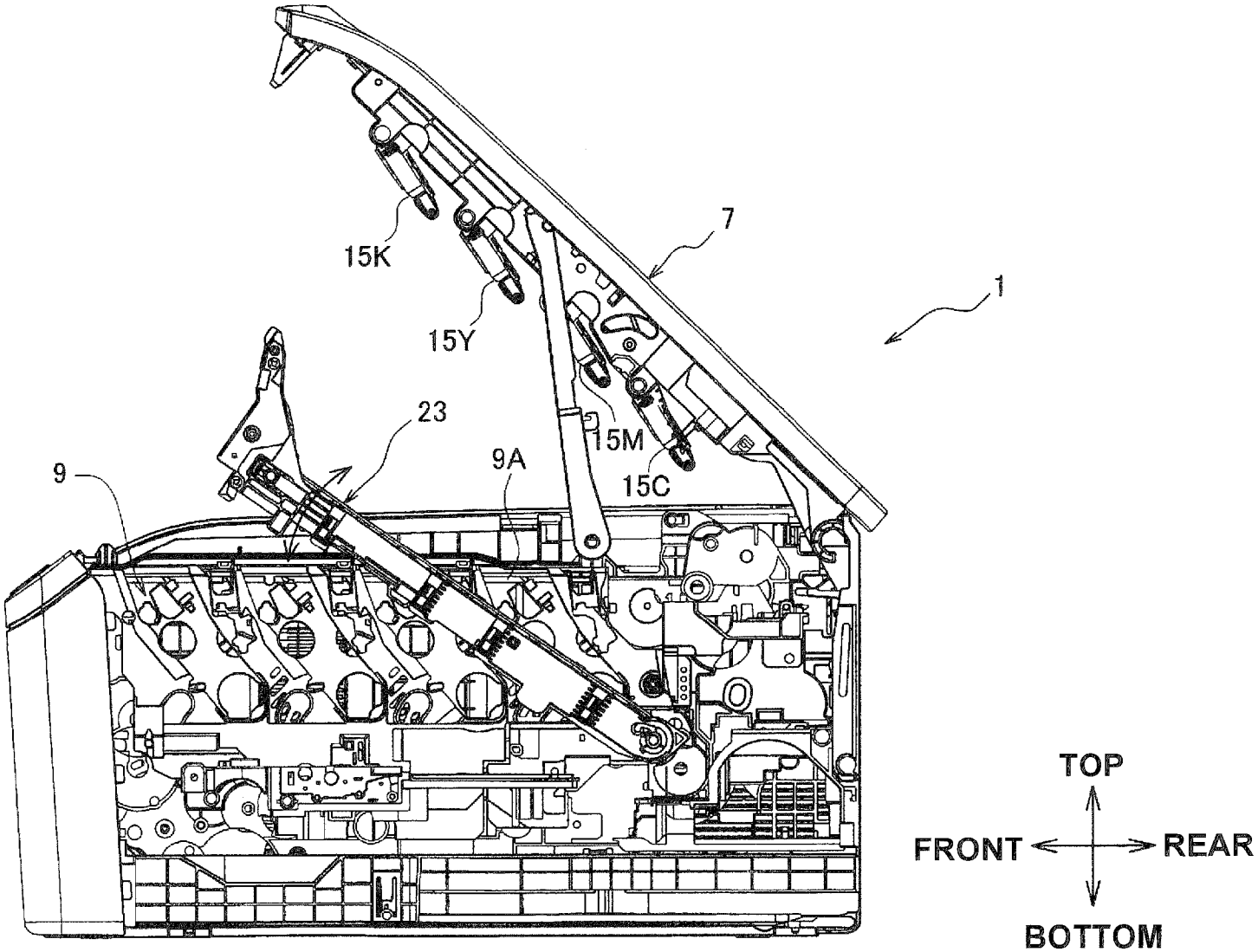
FIG. 2 is a sectional view schematically illustrating an image forming apparatus in which a top cover is open according to an illustrative embodiment.
Figure 3:
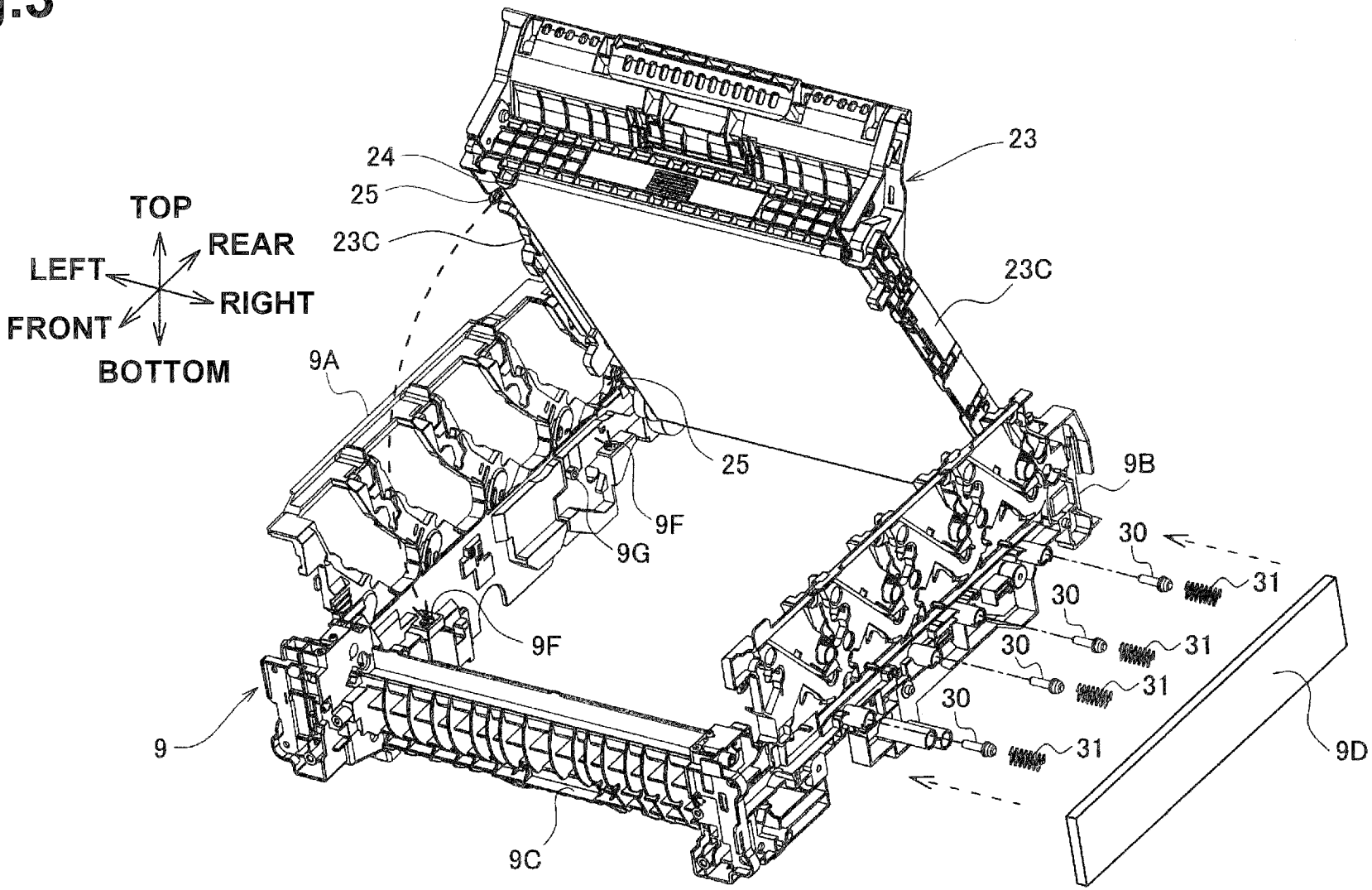
FIG. 3 is a partially exploded perspective view schematically illustrating that a belt unit is attached to a main body frame of the image forming apparatus according to an illustrative embodiment.

As shown in FIG. 1, the image forming apparatus 1 includes a body casing 3 forming an external appearance of the image forming apparatus 1 and a top cover 7 disposed on top of the body casing 3. The top cover 7 is pivotally connected to a main body composed of the body casing 3 and a main body frame 9 (FIG. 3). The body casing 3 inside accommodates an image forming unit 5 and a belt unit 23. The image forming unit 5 and the belt unit 23 can be removed from and attached to the main body when the top cover 7 is opened as shown in FIG. 2.

The image forming unit 5 is configured to electrophotographically form an image on a recording medium, e.g. plain and transparent sheets, (hereinafter referred to as a recording sheet) by transferring a developer image onto the recording sheet. As shown in FIG. 1, the image forming unit 5 includes a plurality of, e.g. four, process cartridges 11 (11K, 11Y, 11M, and 11C), photosensitive drums 13, exposure devices 15 (15K, 15Y, 15M, and 15C), transfer rollers 17, and a fixing unit 19. The process cartridges 11 each contain developer. The process cartridges 11K, 11Y, 11M and 11C respectively contain black developer, yellow developer, magenta developer, and cyan developer. The photosensitive drums 13 are configured to carry developer images of the respective colors thereon. The exposure devices 15 are configured to expose the respective photosensitive drums 13. The transfer rollers 17 are configured to transfer the developer images on the photosensitive drums 13 onto a recording sheet. The fixing unit 19 is configured to fix the developer images transferred onto the recording sheet by heat.

The image forming unit 5 employs a direct tandem system in which the process cartridges 11K, 11Y, 11M, and 11C are arranged and spaced apart in a sheet feeding direction and plural developer images are directly transferred onto a recording sheet. Each process cartridge 11 is detachably attached to the main body frame 9 of the main body when the top cover 7 is open.

Each process cartridge 11 includes a photosensitive drum 13 and a charger 14 for charging the photosensitive drum 13.

The exposure devices 15 include four exposure devices 15K, 15Y, 15M and 15C, which are disposed at positions corresponding to four photosensitive drums 13. Each exposure device 15 includes an LED array. The LED array includes plural light emitting diodes (LEDs) that are arranged in a direction parallel to an axial direction of its corresponding photosensitive drum 13. Each exposure device 15 is configured to expose the photosensitive drum 13 by controlling flashing of LEDs.

Each exposure device 15 is assembled to the top cover 7 so as to move in connection with movement of the top cover 7 between the open position and the closed position. Specifically, when the top cover 7 is open, the exposure devices 15 are disposed in proximity of the top cover 7 as shown in FIG. 2, and when the top cover 7 is closed, the exposure devices 15 are disposed facing the photosensitive drums 13 as shown in FIG. 1.

A sheet supply tray 21 is disposed in a lower portion of the image forming apparatus 1. The sheet supply tray 21 is configured to store a stack of sheets to be fed to the image forming unit 5. The sheets in the sheet supply tray 21 are fed by a pickup roller 21A, separated one by one by a separation roller 21B and a separation pad 21C, and fed toward a belt unit 23.

Developer images carried on the photosensitive drums 13 are sequentially transferred and overlaid one over the other on a recording sheet fed to the belt unit 23 so that a color image is formed on the recording sheet.

As shown in FIG. 3, the main body frame 9 is made up of a first side frame 9A, a second side frame 9B, and a bridge portion 9C. The first side frame 9A and the second side frame 9B are disposed on each side of the image forming unit 5 and the belt unit 23. The bridge portion 9C couples the first side frame 9A and the second side frame 9B and serves as a guide surface for a recording sheet to be fed or a feed chute.

In this illustrative embodiment, the first side frame 9A, the second side frame 9B, and the bridge portion 9C are made of resin. The first side frame 9A and the second side frame 9B are covered with reinforcement plates 9D made of metal, which are fixed using screws, to ensure mechanical strength. In FIG. 3, only one of the reinforcement plates 9D (to be attached to the second side frame 9B) is shown, and the other to be attached to the first side frame 9A is omitted.

Figure 6:
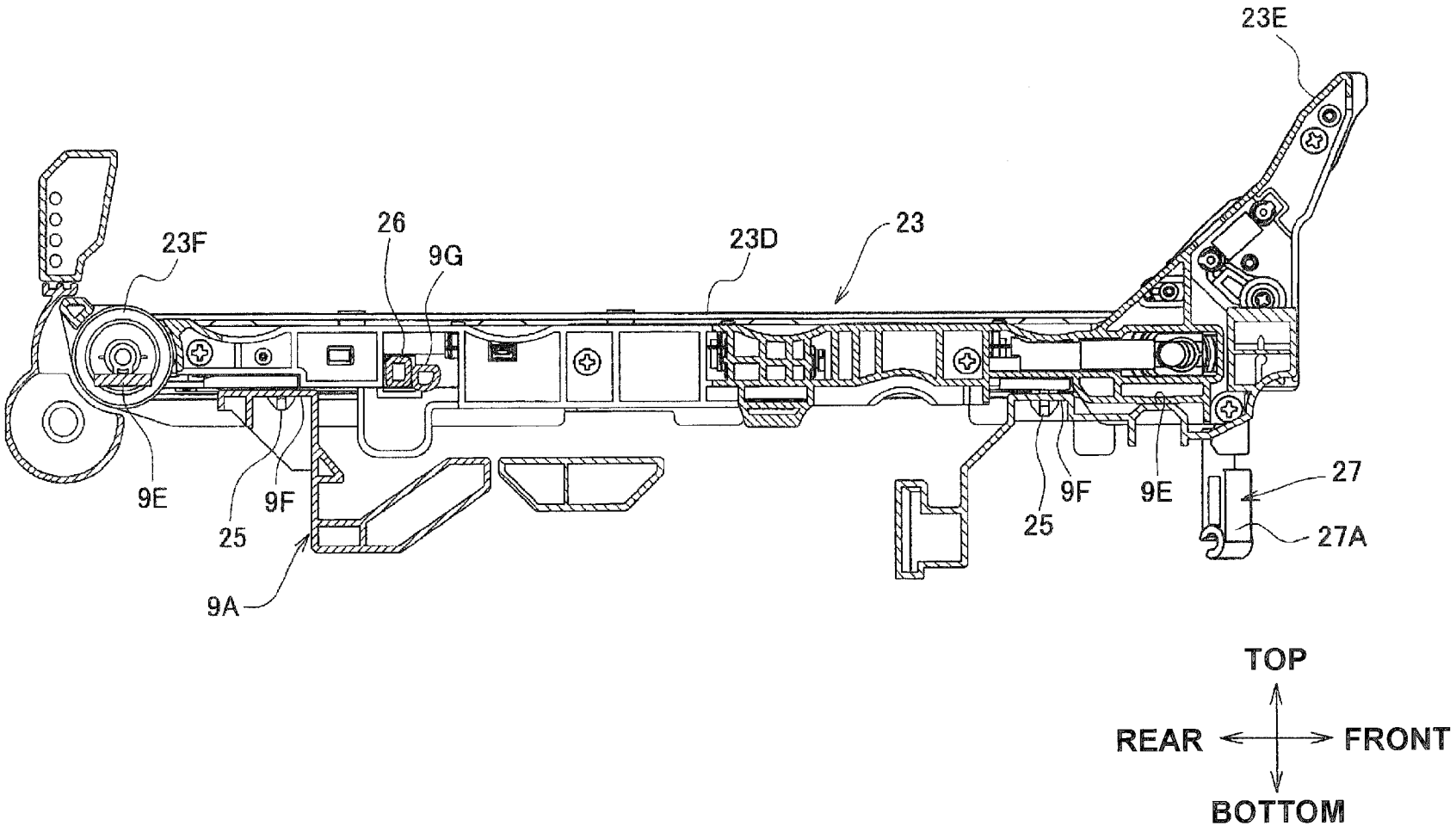
FIG. 6 is a sectional view illustrating the relationship between the belt unit and a first side frame of the main body frame according to an illustrative embodiment.

Each of the first side frame 9A and the second side frame 9B is provided with a plurality of, e.g. two in this illustrative embodiment, supporting portions 9E (see FIG. 6). The supporting portions 9E are provided on inner surfaces of the first side frame 9A and the second side frame 9B to face the belt unit 23 when mounted in the main body frame 9. As shown in FIG. 6, when the belt unit 23 is attached to the main body frame 9, the supporting portions 9E are configured to support the belt unit 23 while receiving the gravity of the belt unit 23 and vertically positioning the belt unit 23.

Near the supporting portions 9E provided on the inner surface of the first side frame 9A, positioning holes 9F are provided for positioning the belt unit 23 relative to the main body frame 9 in a width direction when the belt unit 23 is attached to the main body frame 9.

The width direction is referred to as a direction parallel to an axial direction of a drive roller 23A. In this illustrative embodiment, the width direction coincides with a right-left direction of the image forming apparatus 1. The positioning holes 9F are shorter in the width direction and longer in the front-rear direction of the image forming apparatus 1.

The positioning holes 9F are spaced apart from each other horizontally, e.g. in the front-rear direction of the image forming apparatus 1 in this illustrative embodiment. The inner surface of the first side frame 9A can be provided with a positioning protrusion 9G between adjacent positioning holes 9F. The positioning protrusion 9G can be configured to position the belt unit 23 relative to the main body frame 9 in the front-rear direction. In this illustrative embodiment, the front-rear direction of the image forming apparatus 1 coincides with a direction perpendicular to the width direction and the vertical direction.

The second side frame 9B is not provided with any means for positioning the belt unit 23 relative to the main body frame 9, like the positioning holes 9F and the positioning protrusion 9G in this illustrative embodiment.

A brief overview of the belt unit 23 will be described.

The belt unit 23 can be configured to feed a recording sheet toward the fixing unit 19 while maintaining a relative position of the recording sheet with respect to the photosensitive drums 13. As shown in FIGS. 2 and 3, the belt unit 23 is detachably attached to the main body frame 9.

Figure 4:
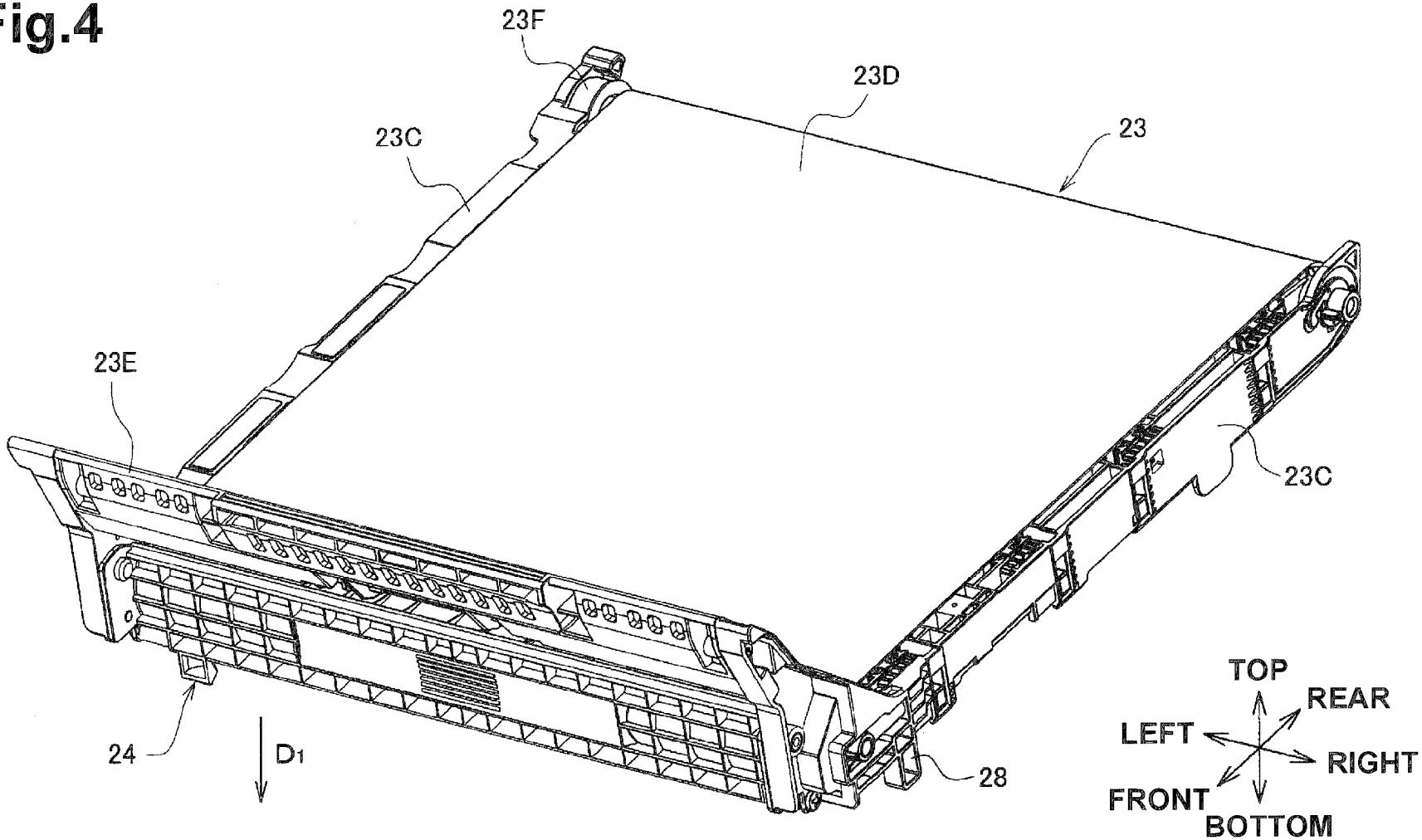
FIG. 4 is a perspective view of the belt unit viewed from above according to an illustrative embodiment.
Figure 5:
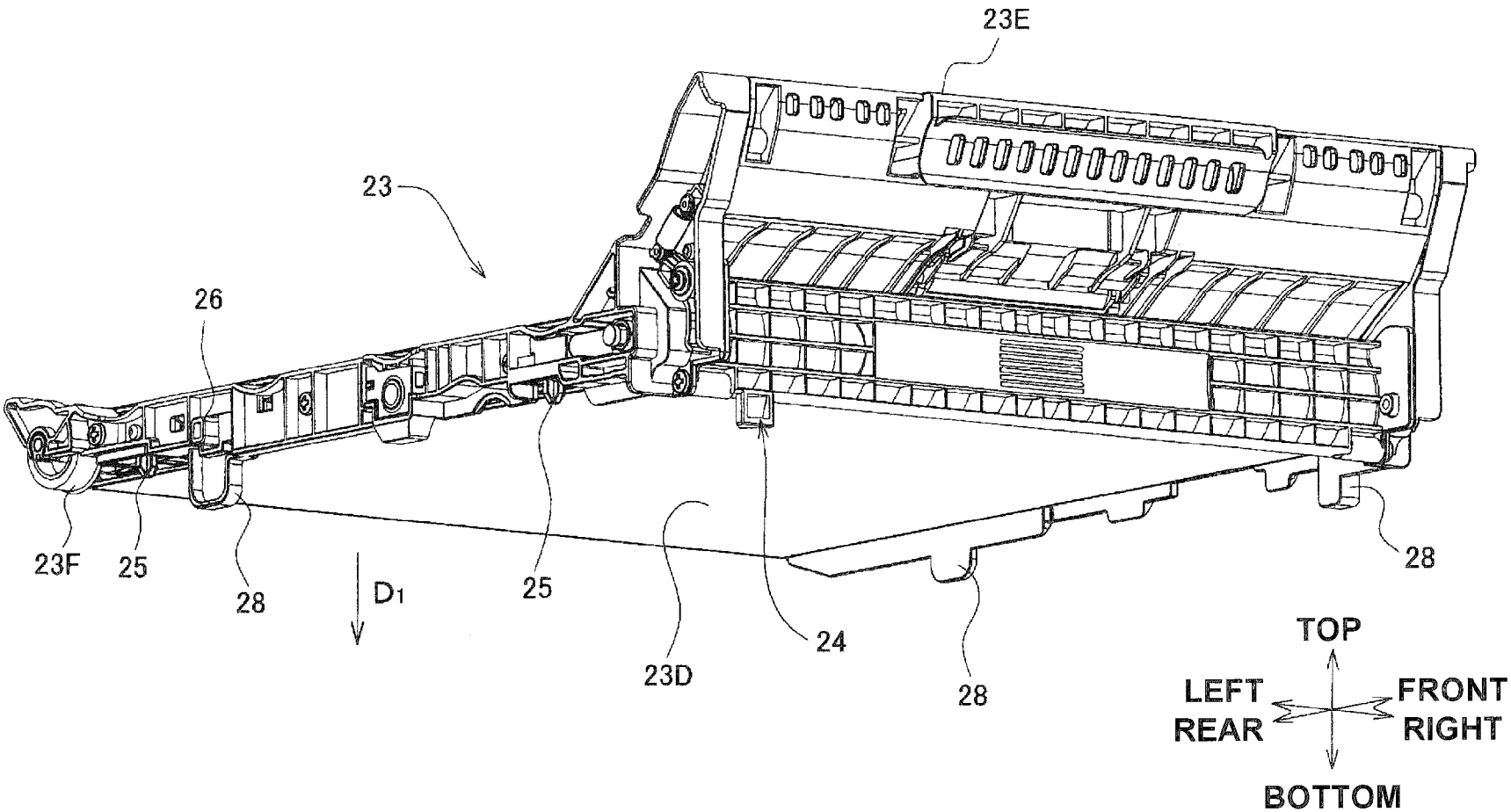
FIG. 5 is a perspective view of the belt unit viewed from below according to an illustrative embodiment.

As shown in FIGS. 1, 4 and 5, the belt unit 23 includes a pair of the drive roller 23A and a driven roller 23B, belt frames 23C, and a belt 23D. The drive roller 23A and the driven roller 23B are disposed such that their axes are parallel to an axial direction of the photosensitive drums 13. The belt frames 23C hold the rollers 23A, 23B. The belt 23D extends between the rollers 23A and 23B.

The belt 23D is an endless belt configured to rotate and feed a sheet toward the fixing unit 19. In other words, the belt 23D forms a continuous moving surface which supports a sheet. When the belt unit 23 is attached to the main body frame 9, a flat surface portion of the continuous moving surface which is formed between the rollers 23A and 23B faces the four photosensitive drums 13 of the process cartridges 11. The transfer rollers 17 are disposed corresponding to the photosensitive drums 13 on a side of the flat surface portion of the belt 23D opposite from the photosensitive drum 13.

The drive roller 23A is configured to drive the belt 23D by rotating responsive to a force received from a power gear 9H (FIG. 8A) which is driven by an electric motor (not shown) provided in the main body. The driven roller 23B is rotated along with the rotation of the belt 23D and serves as a tension roller that applies a specified tension to the belt 23D.

Figure 8A:
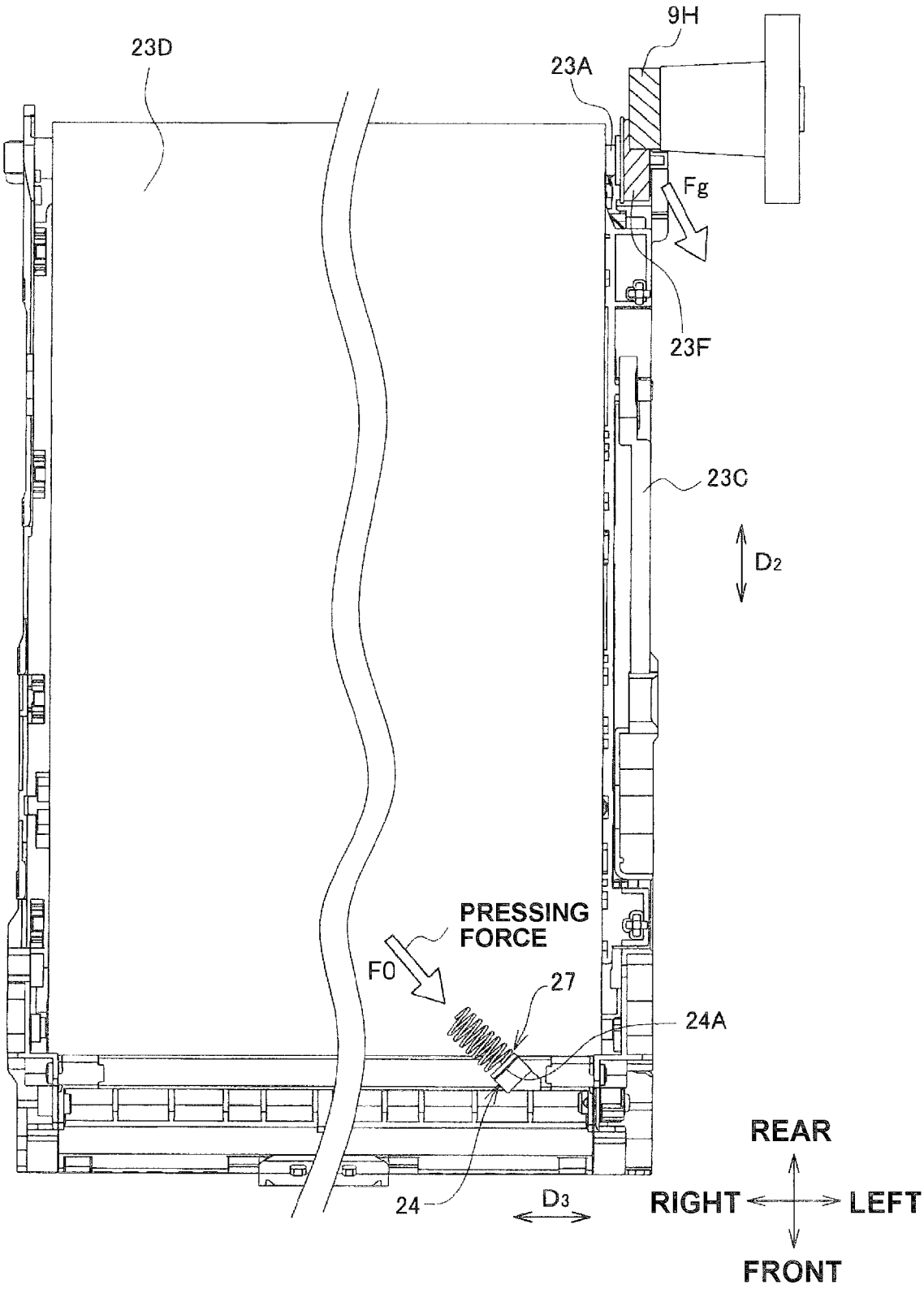
FIG. 8A is a bottom view of the belt unit illustrating a drive gear and a power gear are retained in meshing engagement with each other according to an illustrative embodiment.

As shown in FIG. 8A, one end of the drive roller 23A is provided with a drive gear 23F which is configured to engage the power gear 9H and rotate responsive to the force (Fg) received from the power gear 9H to rotate the belt 23D.

The power gear 9H and the drive gear 23F are helical gears in which the leading edges of teeth are set at an angle to the axis of rotation, such that a direction of the receiving force Fg that the drive gear 23F receives from the power gear 9H during force transfer is substantially parallel (i.e., within 20 degrees) to a direction of a pressing force F0 with which the main body frame 9 presses the belt unit 23.

As shown in FIG. 4, the belt frames 23C are a pair of reinforcing members that are disposed on both longitudinal ends of each of the rollers 23A and 23B, extend from the drive roller 23A toward the driven roller 23B, and rotatably support the rollers 23A and 23B. A handle 23E is disposed on one longitudinal end of the respective belt frames 23C to connect the pair of belt frames 23C. In other words, the handle 23E is disposed on front ends of the respective belt frames 23C in this illustrative embodiment. When the belt unit 23 is removed from or attached to the main body frame 9, the handle 23E is held by the user.

A structure for attaching the belt unit 23 to the main body frame 9 will be described.

As shown in FIGS. 3, 4, and 5, the belt unit 23 is provided with a protrusion 24 in a lower end of the handle 23E. The protrusion 24 is located to be opposite to the sheet supply tray 21 and closer to the first side frame 9A than a central portion of the handle 23E in the width direction when the belt unit 23 is attached to the main body frame 9. The protrusion 24 protrudes in a direction D1, e.g. downward in this illustrative embodiment, where the belt unit 23 is attached to the main body frame 9. Hereinafter the direction D1 is referred to as an attachment direction D1.

In this illustrative embodiment, when the belt unit 23 is attached to the main body frame 9, as shown in FIGS. 2 and 3, the belt unit 23 is pressed downward in such a manner as to rotate on a side of the belt unit 23 closer to the driven roller 23B. Thus, the attachment direction D1 coincides with a direction perpendicular to both a longitudinal direction of the belt frames 23C and an axial direction of the drive roller 23A.

As shown in FIG. 8A, when the belt unit 23 is attached to the main body frame 9, the pressing force F0 applied in a direction crossing the longitudinal direction D2 of the belt frames 23C and the axial direction of the drive roller 23A acts on the protrusion 24 to maintain the belt unit 23 in place in the main body frame 9. In this illustrative embodiment, the longitudinal direction D2 coincides with a front-rear direction of the image forming apparatus 1, a belt extending direction where the belt 23D extends between and wound around the rollers 23A and 23B, and a transfer direction in which a sheet is fed. In addition, the axial direction D3 coincides with a left-right direction or width direction of the image forming apparatus 1.

As shown in FIGS. 5 and 6, the left-side belt frame 23C, which is to be disposed facing the first side frame 9A, is provided with positioning protrusions 25 and 26. The positioning protrusions 25 protrude in the attachment direction D1 and are configured to engage in the respective positioning holes 9F formed in the main body frame 9 when the belt unit 23 is attached to the main body frame 9. The positioning protrusion 26 is configured to contact the positioning protrusion 9G of the main body frame 9 when the belt unit 23 is attached to the main body frame 9. Hereinafter, the positioning protrusions 25 may be referred to as belt-side first protrusions 25, the positioning protrusion 26 may be referred to as a belt-side second protrusion 26, and the positioning protrusion 9G may be referred to as a main body protrusion 9G.

Each of the belt-side first protrusions 25 contacts an inner wall surface of the corresponding positioning hole 9F, which extends along a major axis of the positioning hole 9F, so that the belt unit 23 is positioned in the main body in the width direction. The belt-side second protrusion 26 contacts the main body protrusion 9G as shown in FIG. 6, so that the belt unit 23 is positioned in the main body in the front-rear direction.

Figure 7:
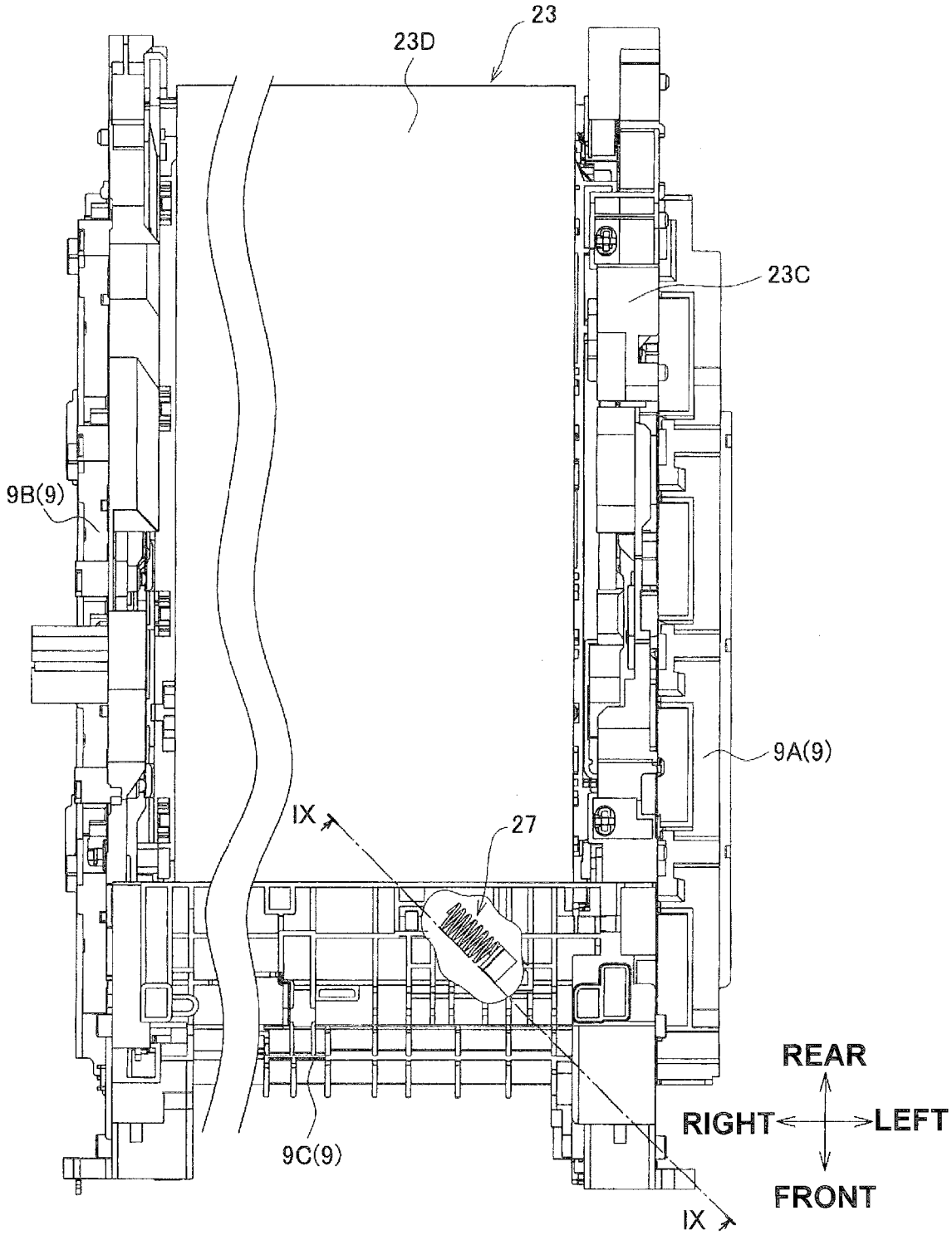
FIG. 7 is a bottom view of the belt unit attached to the main body frame according to an illustrative embodiment.

As shown in FIG. 7, the bridge portion 9C is provided with a pressing hook 27 which is configured to apply the pressing force F0 to the protrusion 24 when the belt unit 23 is attached to the main body frame 9.

Figure 9B:
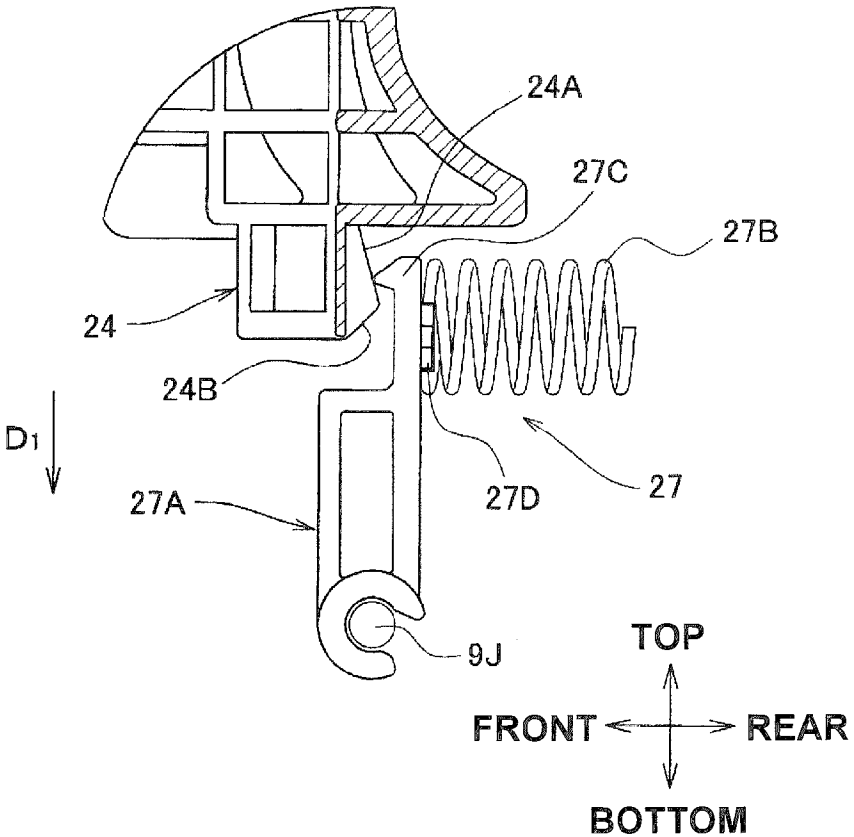
FIG. 9B is an enlarged view of an encircled portion of FIG. 9A.
Figure 9A:
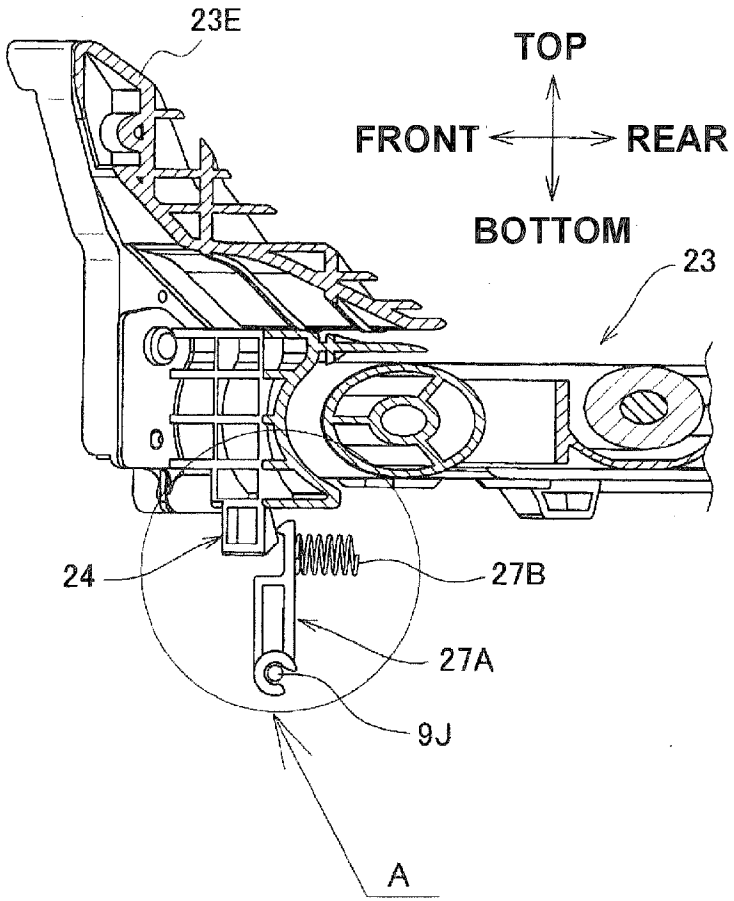
FIG. 9A is a sectional view taken along the line IX-IX of FIG. 7.

As shown in FIGS. 9A and 9B, the pressing hook 27 includes a hook arm 27A and a spring 27B. The hook arm 27A is pivotally attached, at one end or a base end, to a pivot shaft 9J provided in the main body, and extends, at the other end or a distal end, toward the protrusion 24. As shown in FIG. 9B, the hook arm 27A includes an engagement protrusion 27C that is configured to contact the protrusion 24 at the distal end.

The spring 27B is a coil spring that produces an elastic force to press the distal end of the hook arm 27A toward the protrusion 24. The spring 27B is fixed at one end in a boss 27D of the hook arm 27A and at the other end in a boss (not shown) provided in the bridge portion 9C.

As shown in FIG. 9B, the protrusion 24 is formed with an inclined surface 24A that contacts the engagement protrusion 27C of the hook arm 27A. As shown in FIG. 8A, the inclined surface 24A is inclined relative to the longitudinal direction D2 of the belt frames 23C (hereinafter referred to only as a belt extending direction D2) and the axial direction D3 of the drive roller 23A (hereinafter referred to only as an axial direction D3).

When the hook arm 27A presses the inclined surface 24A, a force applied in a direction crossing the belt extending direction D2 and the axial direction D3, that is, the pressing force F0, acts on the protrusion 24.

As shown in FIG. 9B, the inclined surface 24A is also inclined relative to the attachment direction D1, such that the protrusion 24 approaches the hook arm 27A toward a distal end of the pressed protrusion 24 in the attachment direction D1 or toward the pivot shaft 9J. The protrusion 24 is also formed with a guide surface 24B at the distal end in the attachment direction D1. The guide surface 24B continues from the inclined surface 24A and is inclined relative to the attachment direction D1 oppositely from the inclined surface 24A.

Figure 10:
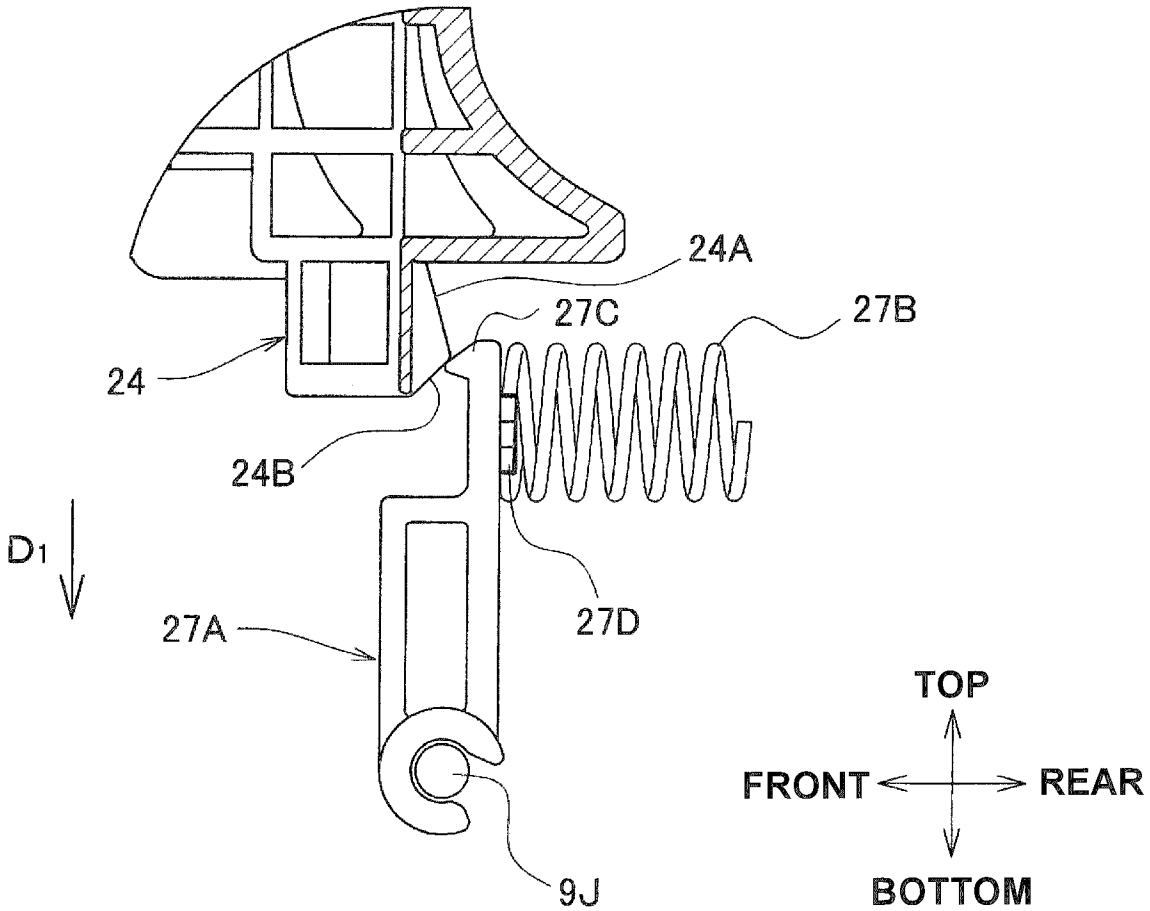
FIG. 10 illustrates an initial state when a protrusion and a pressing hook are engaged according to an illustrative embodiment.

When the belt unit 23 is attached to the main body frame 9, as shown in FIG. 10, the engagement protrusion 27C of the hook arm 27A first contacts the guide surface 24B. Then, the engagement protrusion 27C moves along the guide surface 24B as the belt unit 23 moves in the attachment direction D1, and the hook arm 27A pivots in a direction that causes the spring 27B to deform or compress.

When the engagement protrusion 27C moves over the guide surface 24B, as shown in FIG. 9B, it engages the inclined surface 24A, and the engagement between the engagement protrusion 27C and the inclined surface 24A is maintained by the elastic force of the spring 27B.

As shown in FIG. 5, the belt unit 23 is provided with protrusions 28 protruding downward as well as the protrusion 24. The protrusion 24 and the protrusions 28 extend below the belt 23D and serve as legs on which the belt unit 23 stands when the belt unit 23 is removed from the main body frame 9.

Figure 11:
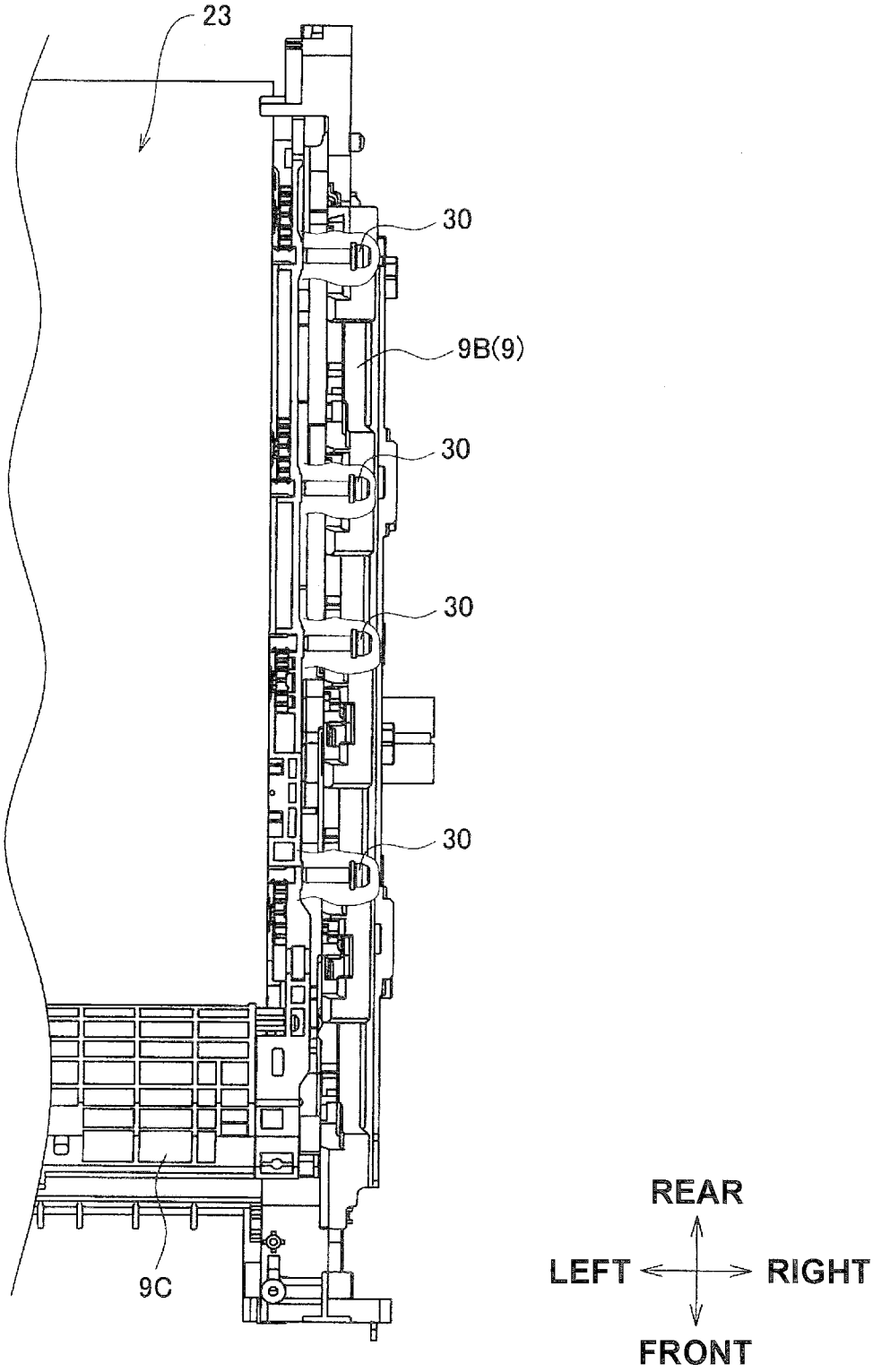
FIG. 11 is a top view of the belt unit attached to the main body frame according to an illustrative embodiment.
Figure 12:
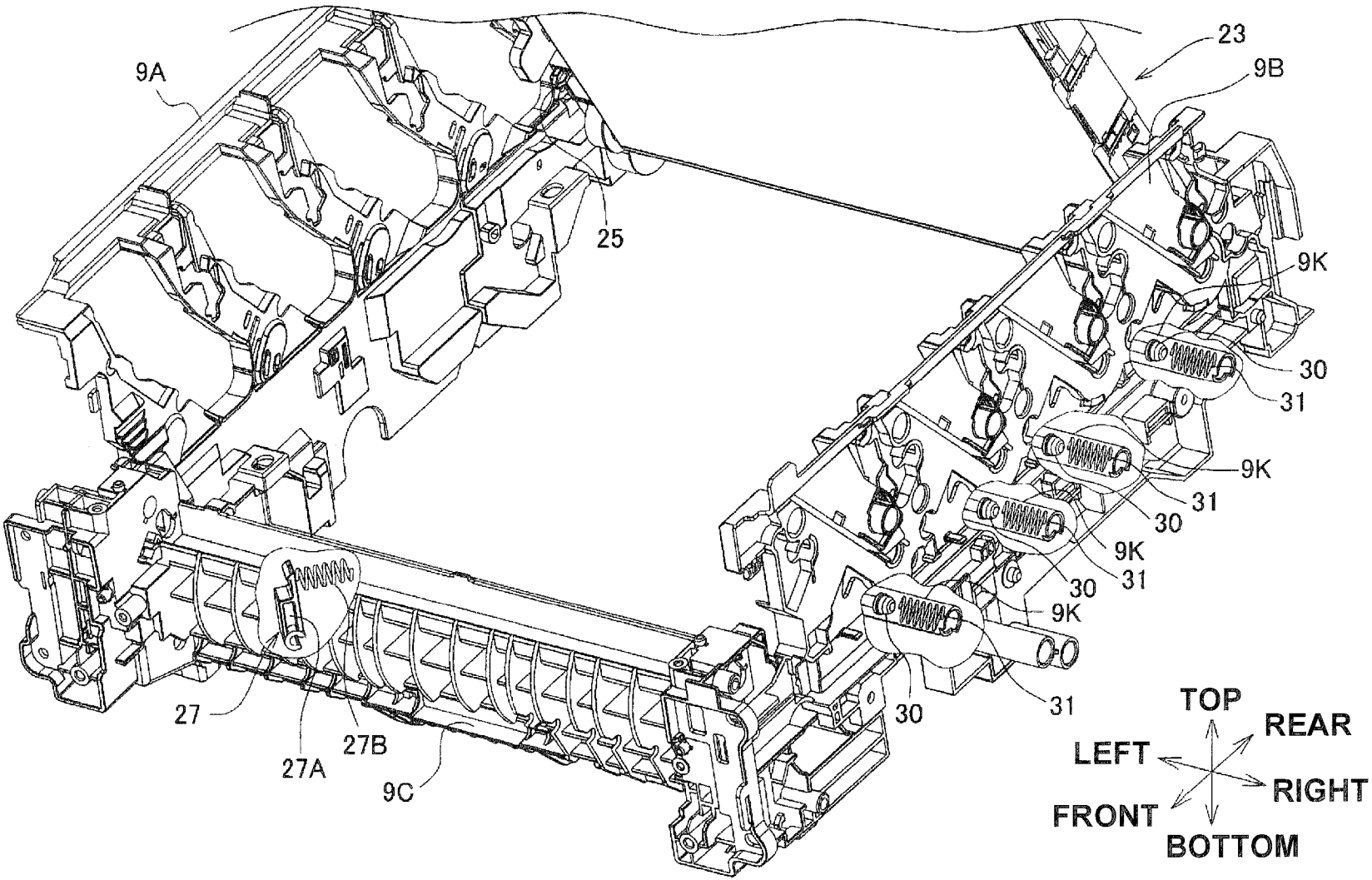
FIG. 12 is a perspective view illustrating the belt unit attached to the main body frame according to an illustrative embodiment.

As shown in FIGS. 11 and 12, the second side frame 9B includes a plurality of, e.g., four, electrodes 30 for applying and supplying voltage to the transfer rollers 17. As described above, the transfer rollers 17 are configured to transfer developer images formed on the photosensitive drums 13 onto a recording sheet.

Specifically, as shown in FIG. 12, the second side frame 9B is integrally formed with tubes 9K extending in the width direction. Each tube 9K contains an electrode 30 and a spring 31 that presses the electrode 30 toward the belt unit 23. The tubes 9K are closed by the reinforcement plate 9D (FIG. 3) on an opposite side from the belt unit 23.

With this structure, when the belt unit 23 is attached to the main body frame 9, the belt unit 23 is pressed by the electrodes 30 in the axial direction D3 from the second side frame 9B toward the first side frame 9A.

Figure 8B:
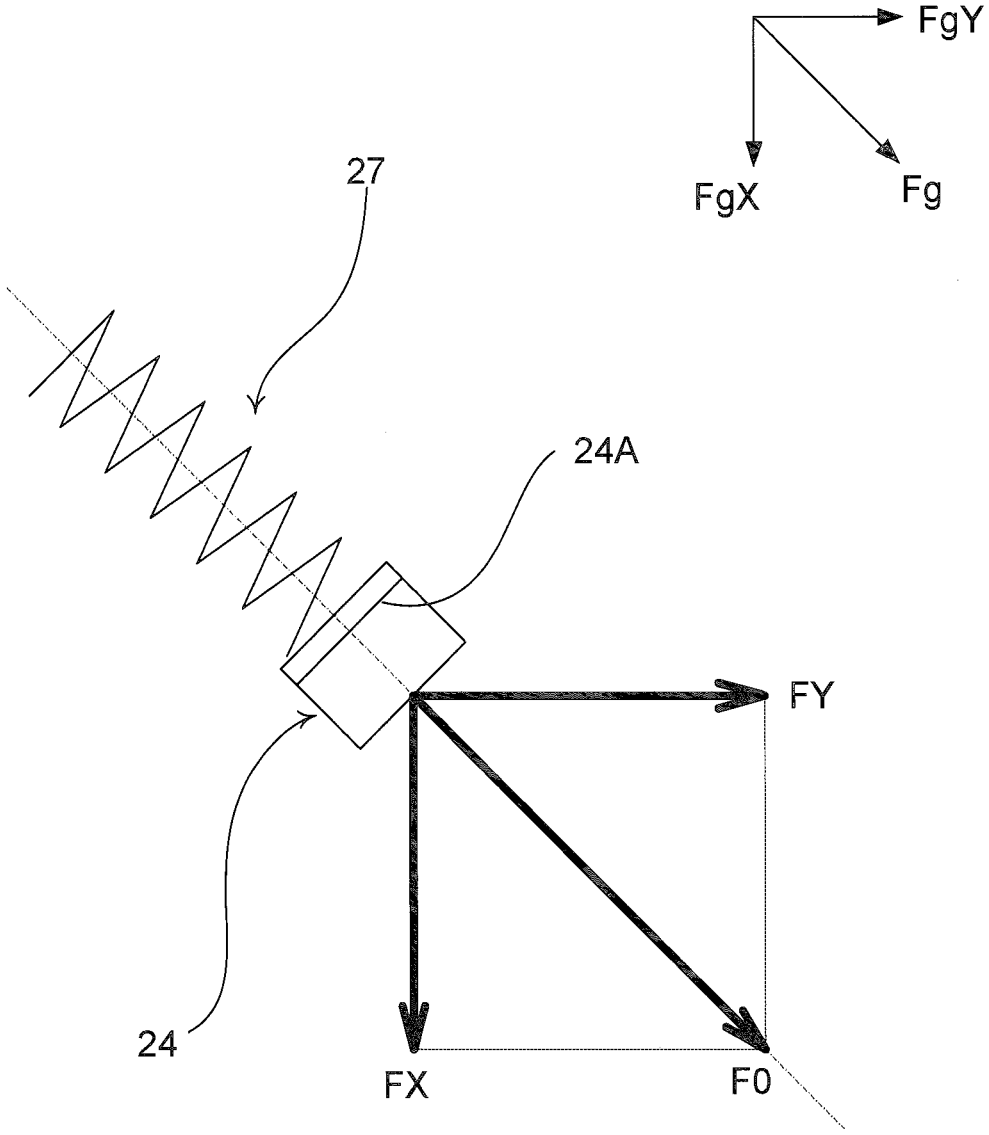
FIG. 8B schematically illustrates a relationship between a pressing force with which the main body frame presses the belt unit therein and its component forces, and a relationship between a receiving force that a drive gear receives from a power gear and its component forces according to an illustrative embodiment.

In this illustrative embodiment, when the belt unit 23 is placed in the main body frame 9, it receives the pressing force F0 applied in the direction crossing the belt extending direction D2 and the axial direction D3. Thus, as shown in FIG. 8B, the pressing force F0 has an x-component force FX, which is a component of the force applied in a direction parallel to the axial direction D2, and a y-component force FY, which is a component of the force applied in a direction parallel to the belt extending direction D2.

The x-component force FX is different in direction from the y-component force FY. The first belt-side protrusions 25 and the second belt-side protrusion 26 are pressed against the positioning holes 9F and the main body protrusion 9G respectively in two different directions by the x-component force FX and the y-component force FY. Thus, play of the belt unit 23 relative to the main body frame 9 is eliminated, so that the belt unit 23 is secured to the main body.

Specifically, the x-component force FX allows the belt-side second protrusion 26 to be pressed against the main body protrusion 9G, so that the belt unit 23 is positioned in the main body in the front-rear direction. The y-component force FY allows the belt-side first protrusions 25 to be pressed against the inner walls of the respective positioning holes 9F which are orthogonal to the minor axes of the positioning holes 9F, so that the belt unit 23 is positioned in the main body in the width direction.

In this illustrative embodiment, the belt unit 23 includes the protrusion 24 having the inclined surface 24A that is inclined relative to the belt extending direction D2 and the axial direction D3, and the main body includes the pressing hook 27 that contacts and presses the inclined surface 24A when the belt unit 23 is placed in the main body.

With this structure, a pressing force with which the pressing hook 27 presses the inclined surface 24A is converted into a force having both the x-component force FX and the y-component force FY at the inclines surface 24A. In short, the pressing force is converted into the pressing force F0. Thus, the belt unit 23 can be accurately positioned with the pressing hook 27 presses the inclined surface 24A.

In this illustrative embodiment, the inclined surface 24A is also inclined relative to a direction perpendicular to the belt extending direction D2 and the axial direction D3. In short, the inclined surface 24A is also inclined relative to a vertical direction. This means that the pressing force F0 also includes a z-component force, which is a force of the component applied in a vertical direction, which is different in direction from the x-component force FX and the y-component force FY. Thus, the belt-side first protrusions 25 and the belt-side second protrusion 26 are pressed against the positioning holes 9F and the main body protrusion 9G respectively with three different directions by the x-, y- and z-component forces.

In other words, in the illustrative embodiment, the x-component force FX and the y-component force FY eliminate horizontal play of the belt unit 23 with respect to the main body, and the z-component force eliminates vertical play of the belt unit 23 with respect to the main body, so that the belt unit 23 is secured to the main body.

In this illustrative embodiment, the belt unit 23 can be secured to the main body in a state that play in each of the x, y and z directions between the belt unit 23 and the main body can be eliminated.

In this illustrative embodiment, the protrusion 24 is provided with the guide surface 24B, which is provided at the distal end of the protrusion 24A and forms a continuous surface upward to the inclined surface 24A. The guide surface 24B is inclined in an opposed direction relative to the attachment direction D1 compared with the inclined surface 24A. The guide surface 24B is configured to guide the pressing hook 27 to the inclined surface 24A while the belt unit 23 is attached to the main body.

With the provision of the guide surface 24B, the pressing hook 27 can be easily guided to the inclined surface 24A, and the belt unit 23 can be easily secured to the main body in a manner to engage the pressing hook 27 and the protrusion 24 as shown in FIG. 9B.

While the pressing hook 27 responds to an elastic device such as a spring to produce the pressing force F0, the protrusion 24 is configured to receive the pressing force F0. Thus, the pressing hook 27 can become more complicated in structure than the protrusion 24.

The belt unit 23 is configured to be attached to and removed from the main body. The pressing hook 27 may have a structure more complicated than the protrusion 24 and it is undesirable that the pressing hook 27 be provided in the belt unit 23. Therefore, in this illustrative embodiment, the protrusion 24 is disposed in the belt unit 23 and the pressing hook 27 is disposed in the main body.

In this illustrative embodiment, the power gear 9H and the drive gear 23F may be configured such that the receiving force Fg that the drive gear 23F receives from the power gear 9H during force transfer is applied in a forward direction with respect to the direction of the pressing force F0. Preferably, the direction of the receiving force Fg is substantially parallel (i.e., within 20 degrees) to the direction of the pressing force F0.

As is the case with the pressing force F0, as shown in FIG. 8B, the receiving force Fg has an x-component force FgX, which is a component of the force applied in a direction parallel to the axial direction D3, and a y-component force FgY, which is a component of the force applied in a direction parallel to the belt extending direction D2. Thus, the resultant of the receiving force Fg and the pressing force F0 is greater in magnitude than the pressing force F0.

With this configuration, in this illustrative embodiment, the receiving force Fg can be also used to press the belt-side first protrusions 25 and the belt-side second protrusion 26 against the positioning holes 9F and the main body protrusion 9G respectively. Therefore, potential displacement of the belt unit 23 relative to the main body during force transfer can be minimized, and thus the belt unit 23 can be accurately positioned in place and secured to the main body.

For example, if the assumption is made that the direction of the receiving force Fg is opposite to the direction of the pressing force F0, the resultant of the receiving force Fg and the pressing force F0 may be smaller in magnitude than the pressing force F0, and the belt unit 23 may be displaced relative to the main body during force transfer.

However, in this illustrative embodiment, as the resultant of the receiving force Fg and the pressing force F0 is greater in magnitude than the pressing force F0, the chance of the above problem happening can be reduced.

In this illustrative embodiment, the direction of the receiving force Fg that the drive gear 23F receives from the power gear 9H during force transfer is substantially parallel to the direction of the pressing force F0. Thus, the receiving force Fg can be effectively used to press the first belt side projections 25 and the second belt side projection 26 against the positioning holes 9F and the main body protrusion 8G respectively.

In addition, in this illustrative embodiment, the electrodes 30 urge the belt unit 23 toward the first side frame 9A in a direction parallel to the axial direction D3. Thus, the belt unit 23 can be reliably secured to the main body and the transfer rollers 17 can be constantly supplied with power.

In the above illustrative embodiment, while the belt unit 23 is placed in the main body, the belt extending direction D2, the axial direction D3 and the direction of the pressing force F0 coincide with horizontal directions. However, the disclosure is not limited to the horizontal directions. The direction of the pressing force F0 may not coincide with a horizontal direction.

In the above illustrative embodiment, the x-component force FX, the y-component force FY, and the z-component force are finally received at the positioning holes 9F, the main body protrusion 9G, and the supporting portions 9E, respectively. Thus, any arrangement is possible as long as the arrangement allows the positioning holes 9F, the main body protrusion 9G and the supporting portions 9E to receive the x-component force FX, the y-component force FY, and the z-component force, respectively.

For example, the positioning holes 9F may be constructed as a first receiving surface that receives the x-component force FX, the main body protrusion 9G may be constructed as a second receiving surface that receives the y-component force FY, and the supporting portions 9E may be constructed as a third receiving surface that receives the z-component force. The first receiving surface, the second receiving surface and the third receiving surface may be separately provided or integrally formed.

The above illustrative embodiment shows, but is not limited to, the power gear 9H and the drive gear 23F being helical gears. For example, the power gear 9H and the drive gear 23F may be spur gears or couplings.

The above illustrative embodiment shows, but is not limited to, the protrusion 24 being provided with the inclined surface 24A. If the pressing force F0 is applied in a direction crossing the belt extending direction D2 and the axial direction D3 acts on the belt unit 23, the protrusion 24 may be formed into a simple configuration, e.g., a cylindrical shape.

In the above illustrative embodiment, the protrusion 24 is provided with the guide surface 24B because the belt unit 23 is engaged with the main body at the protrusion 24 that receives the pressing force F0. If a device for engaging the belt unit 23 with the main body is additionally provided, the guide surface 24B may be eliminated and the inclined surface 24A may be inclined only relative to the belt extending direction D2 and the axial direction D3.

In the above illustrative embodiments, the disclosure is applied to, but not limited to, a direct tandem type image forming apparatus.

The above illustrative embodiment shows, but is not limited to, the image forming apparatus being provided with the exposure devices 15 using LED arrays. The exposure devices 15 may comprise a laser scanner that emits laser beams.

In the above illustrative embodiments, the belt unit 23 is configured to feed a recording medium. However, the disclosure is not limited to this kind of belt unit. The disclosure may be applied to a belt unit of intermediate transfer type in which a developer image formed on a belt is transferred onto a recording sheet. Unless otherwise described herein, the term "belt unit" is intended to cover both belt units that convey recording mediums and belt units that convey developer images to recording mediums.

The above illustrative embodiment shows, but is not limited to, the protrusion 24 being provided in the belt unit 23 and the pressing hook 27 being disposed in the main body. The protrusion 24 may be disposed in the main body and the pressing hook 27 may be disposed in the belt unit 23.

Although an illustrative embodiment and examples of modifications of the present disclosure have been described in detail herein, the scope of the disclosure is not limited thereto. It will be appreciated by those skilled in the art that various modifications may be made without departing from the scope of the disclosure. Accordingly, the embodiment and examples of modifications disclosed herein are merely illustrative. It is to be understood that the scope of the disclosure is not to be so limited thereby, but is to be determined by the claims which follow.

What is claimed is:

1. An image forming apparatus configured to form an image on a recording sheet comprising:

a main body;

a belt unit including a first roller and a second roller, an endless belt extending between the first and second rollers, and a frame supporting the first roller and the second roller, wherein the first and second rollers are spaced apart in a belt extending direction where the belt extends between the first and second rollers;

a pressing member configured to press the belt unit to exert a pressing force in a pressing direction, the pressing force having a component force applied in a specific direction parallel to a surface of the belt, and the specific direction crossing both the belt extending direction and an axial direction of the first roller;

a first positioning portion disposed in the main body;

a second positioning portion disposed in the belt unit, the second positioning portion being configured to contact the first positioning portion to allow the belt unit to be positioned in the main body; and a pressed portion including an inclined surface that is inclined with respect to both the belt extending direction and the axial direction, wherein the pressing member is configured to press the belt unit such that the second positioning portion maintains contact with the first positioning portion when the belt unit is positioned in the main body; and wherein the pressing member presses the inclined surface when the belt unit is attached to the main body.

2. The image forming apparatus according to claim 1, wherein the pressing member is disposed in the main body, and the pressed portion is disposed on the belt unit.

3. The image forming apparatus according to claim 1, wherein the inclined surface is also inclined with respect to a first direction perpendicular to the belt extending direction and the axial direction.

4. The image forming apparatus according to claim 3, wherein the pressed portion protrudes from the belt unit in the first direction, the pressed portion includes a guide surface at a distal end of the pressed portion in the first direction, the guide surface continues from the inclined surface and is inclined relative to the first direction oppositely from the inclined surface, and the guide surface is configured to guide the pressing member to the inclined surface when the belt unit is being attached to the main body.

5. The image forming apparatus according to claim 1, wherein the main body includes a first gear, the belt unit includes a second gear that is configured to engage the first gear and rotate by receiving a receiving force from the first gear to rotate the belt in the belt extending direction, and the first gear and the second gear are configured such that the receiving force is applied in a direction that follows the pressing direction.

6. The image forming apparatus according to claim 5, wherein the first gear and the second gear engage with each other such that the receiving force is applied in a direction within 20 degrees of the pressing direction.

7. The image forming apparatus according to claim 6, wherein the first gear and the second gear are helical gears.

8. The image forming apparatus according to claim 1, further comprising:

an image carrier disposed on one side of the belt and configured to carry a developer image thereon;

a transfer device disposed on the other side of the belt, the transfer device being assembled to the frame at a position opposite to the image carrier; and an electrode disposed in the main body, the electrode being configured to supply voltage to the transfer device such that the electrode presses the belt unit in a direction parallel to the axial direction of the first roller, wherein the transfer device is configured to transfer the developer image carried on the image carrier onto a recording sheet when the voltage is supplied to the transfer device from the electrode.

9. The image forming apparatus according to claim 2, wherein the belt unit includes a plurality of legs extending in a direction perpendicular to the belt extending direction and the axial direction of the first roller, and one of the legs includes the pressed portion.

10. An image forming apparatus configured to form an image on a recording sheet, comprising a main body;

a belt unit including a first roller and a second roller, an endless belt extending between the first and second rollers, and a frame supporting the first roller and the second roller, wherein the first and second rollers are spaced apart in a belt extending direction where the belt extends between the first and second rollers;

a pressing member configured to press the belt unit to exert a pressing force in a pressing direction, the pressing force having a component force applied in a specific direction parallel to a surface of the belt, and the specific direction crossing both the belt extending direction and an axial direction of the first roller;

a first positioning portion disposed in the main body; and a second positioning portion disposed in the belt unit, the second positioning portion being configured to contact the first positioning portion to allow the belt unit to be positioned in the main body, wherein the pressing member is configured to press the belt unit such that the second positioning portion maintains contact with the first positioning portion when the belt unit is positioned in the main body, wherein the pressing member includes an arm and a spring, the arm is attached to the main body and, the spring is configured to produce an elastic force to press the arm to make contact with the belt unit when the belt unit is attached to the main body.

11. The image forming apparatus according to claim 10, wherein the arm includes an engagement protrusion and the engagement protrusion is configured to contact the belt unit.

12. The image forming apparatus according to claim 10, wherein the arm is configured to pivot about an axis.

13. The image forming apparatus according to claim 1, wherein, when the belt unit is positioned in the main body, the belt extending direction and the axial direction coincide with horizontal component force directions of the pressing force.

14. The image forming apparatus according to claim 1, wherein the belt unit is configured to be attached to and removed from the main body.

15. An image forming apparatus configured to form an image on a recording sheet, comprising:

a main body;

a belt unit including a first roller and a second roller, an endless belt extending between the first and second rollers, and a frame supporting the first roller and the second roller, wherein the first and second rollers are spaced apart in a belt extending direction where the belt extends between the first and second rollers;

a pressing member configured to press the belt unit to exert a pressing force in a pressing direction, the pressing force having a component force applied in the pressing direction parallel to a surface of the belt, and the pressing direction crossing both the belt extending direction and an axial direction of the first roller;

a first positioning portion disposed in the main body;

a second positioning portion disposed in the belt unit, the second positioning portion being configured to contact the first positioning portion to allow the belt unit to be positioned in the main body in the axial direction;

a third positioning portion disposed in the main body and apart from the first positioning portion;

a fourth positioning portion disposed in the belt unit and apart from the second positioning portion, the fourth positioning portion being configured to contact the third positioning portion to allow the belt unit to be positioned in the main body in the belt extending direction; and a pressed portion including an inclined surface that is inclined with respect to both the belt extending direction and the axial direction, wherein the pressing member is configured to press the belt unit such that the second positioning portion maintains contact with the first positioning portion and the fourth positioning portion maintains contact with third positioning portion when the belt unit is positioned in the main body, and wherein the pressing member presses the inclined surface when the belt unit is attached to the main body.

16. The image forming apparatus according to claim 15, wherein the first positioning portion receives a force applied in a direction parallel to the axial direction, and the third positioning portion receives a force applied in a direction parallel to the belt extending direction.

17. The image forming apparatus according to claim 15, wherein the main body includes a first gear, the belt unit includes a second gear that is configured to engage the first gear and rotate by receiving a receiving force from the first gear to rotate the belt in the belt extending direction, and the first gear and the second gear are configured such that the receiving force is applied in a direction that follows the pressing direction.

* * * * *